United States Patent [19]

Maman

[11] Patent Number: 5,034,723

[45] Date of Patent: Jul. 23, 1991

[54] SECURITY CABLE AND SYSTEM FOR PROTECTING ELECTRONIC EQUIPMENT

[75] Inventor: Maman, Mt. Vernon, N.Y.

[73] Assignee: Nynex Corporation, New York, N.Y.

[21] Appl. No.: 487,421

[22] Filed: Mar. 1, 1990

[51] Int. Cl.[5] ..... G08B 21/00

[52] U.S. Cl. ..... 340/568; 340/652; 340/687; 439/489

[58] Field of Search ..... 340/568, 652, 687; 439/489

[56] References Cited

U.S. PATENT DOCUMENTS 4,121,201 10/1978 Weathers ..... 340/687

4,390,868 6/1983 Garwin ..... 340/568

4,584,570 4/1986 Dotson ..... 340/568

*Primary Examiner*—Glen R. Swann, III

*Attorney, Agent, or Firm*—Douglas Kirk; John J. Torrente

[57] ABSTRACT

A cable for supplying power to electrical equipment is adapted to also provide security for the equipment by being formed to have a first state when it is connected to the equipment and a second state when it is disconnected from the equipment, whereby detection of the states of the cable permit detection of removal of the equipment which can then be communicated through repair AC power lines to a central station.

29 Claims, 3 Drawing Sheets

SECURITY CABLE AND SYSTEM FOR PROTECTING ELECTRONIC EQUIPMENT

BACKGROUND OF THE INVENTION

This invention relates to electrical equipment and, in particular, to an apparatus and method of detecting authorized removal of such electrical equipment.

Advancements in the field of electronics have resulted in a significant reduction in the size of electrical components. This permits the design of small, very complex and often very costly pieces of equipment. Such advancements are advantageous in that modern equipment is more transportable and requires less space on a desk or workstation. However, the smaller the equipment, the more difficult it becomes to secure it against theft. For example, a computer of 5 years ago was too large for an employee to walk unnoticed out of a building with. Today, thousands of dollars, and sometimes tens of thousands of dollars, worth of computer equipment may be placed in a single brief case and carried out of a building. Furthermore, once stolen, smaller equipment is easier for the thief to hide and dispose of. There does not appear to be an end in sight to the increased miniaturization of advanced electronic devices and, therefore, the need for theft protection will increase.

For electrical equipment in use today, a variety of methods of securing the equipment are available. First, for computers, a special electronic card may be designed to install inside the computer. The card responds to polls from an external monitoring station. When the computer, and therefore the card, is removed, the card stops responding to the polling of the central station and an alarm is initiated. However, major disadvantages to this method exist in that not all computers are compatible with the electronic card, the electronic card may not be used in the computer peripheral devices such as printers and monitors, and the card may be expensive.

A second method of protection is to wire a pressure sensor or micro-switch into the computer which causes a local alarm to sound when the computer is moved. This also is disadvantageous because it requires incorporating these components into the computer.

A third method of protection is to place a non-removable tag on or in each piece of equipment. A sensing device, responsive to the presence of the tag, is situated at each exit point of the premises. If an attempt is made to move equipment containing a tag past a sensing device, an alarm will be initiated. The disadvantage of this method is readily apparent in locations having multiple exit points. Each exit point requires a costly sensing device.

A fourth method of protecting electrical equipment is described in U.S. Pat. No. 4,390,868. In this method, the cable connecting the equipment to the electrical power source is modified to include two light transmitting channels extending through the cable and two light sources at the end of the cable that plugs into the wall. The equipment to be protected is specially modified with two light sensors so that it will only operate when the special cable with its two light channels is present. The special cable is then non-removably affixed at the location where the equipment is to be used. It is assumed that the equipment will not be stolen because of difficulty in obtaining an equivalent cable. However, this method of deterrence will only work with equipment that is specially modified. Further, if the deterrence does not work and the equipment is actually taken, no alarm will be initiated.

It is therefore an object of the present invention to provide an apparatus and method by which electrical equipment may be protected from theft.

It is a further object of the present invention to provide a cable adapted to standard electrical equipment so that removal of equipment by unplugging or cutting of the cable is detected.

It is still a further object of the present invention to provide an apparatus and method for detecting removal of electrical equipment and transmitting such information to a central location through the existing AC power lines so that no separate wiring is necessary.

SUMMARY OF THE INVENTION

In accordance with the principles of the present invention, the above and other objectives are realized by providing an apparatus and method for connecting electrical equipment to a power source or supply in which a cable is provided and adapted to have a first state when connected to the electrical equipment and a second state when disconnected from the electrical equipment. By monitoring the state of the cable via a detection and alarm device, a determination can be made as to when the electrical equipment is improperly disconnected from the cable, and thus, when the equipment is in the process of being moved without authorization.

In the embodiment of the invention to be described hereinafter, the connecting cable comprises a first connector adapted to be removably connected to the electrical equipment, a second connector adapted to be removably connected to the power source through the detection and alarm device, power conductors connecting the first connector to the second connector, and first and second status conductors adapted to exhibit a first impedance value between the individual status conductors corresponding to the first state of the cable when the electrical equipment is connected to the equipment and a second impedance value between the individual status conductors corresponding to the second state of the cable when the electrical equipment is disconnected from the cable.

Also, in this embodiment, the detection and alarm device, situated between the cable and the power source, detects the impedance value of the status conductors and causes an alarm signal when the second impedance value is detected or when the device is disconnected from the power source. In other words in normal condition the status conductors will be normally closed. Unplugging or cutting the cable will change the status to open.

BRIEF DESCRIPTION OF THE DRAWING

The above and other features and aspects of the present invention will become more apparent upon reading the following detailed description in conjunction with the accompanying drawings in which.

DETAILED DESCRIPTION

Figure 1:
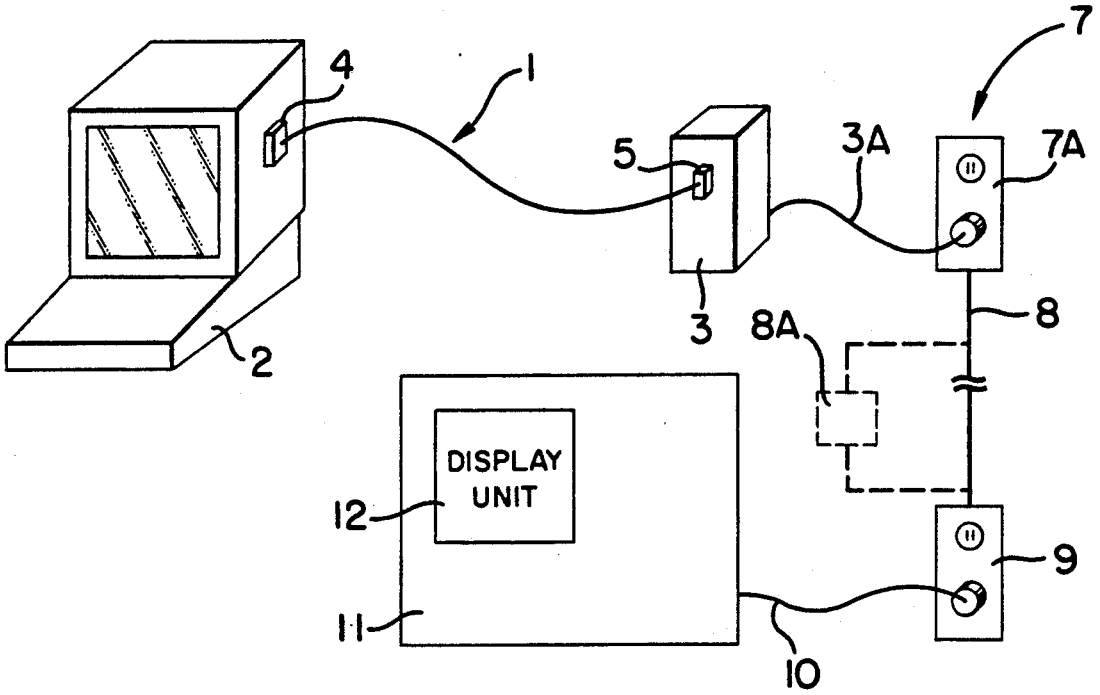
FIG. 1 snows an apparatus in accordance with the principles of the present invention.

In FIG. 1, electronic equipment 2, in this case shown as a computer, is connected via a cable 1 and a detection and alarm device 3 to a power source 7. As illustrated, the power source 7 is provided by an outlet 7A of the AC electrical service serving the premises where the computer 2 is located.

A female plug 4, on one end of the cable 1, mates with the equipment 2 and a male plug 5, on the opposite end of the cable, mates with the detection and alarm device 3. The latter device 3 includes a power cord 3A whose male plug end connects the device 3 to the power outlet 7A. With this connecting arrangement, power flows from power source 7 to the detection and alarm device 3, from the device 3 to the cable 1, and from the cable 1 to the equipment 2.

In accordance with the principles of the present invention and as will be discussed in greater detail below, the connecting cable 1 is adapted such that when the equipment 2 is disconnected from the cable 1, as when the equipment 2 is removed from female connector 4 or the cable 1 is cut, the cable changes from a first or closed to second or open state, causing the device 3 to generate an alarm signal which contains a unique address identifying the device 3. The alarm signal is generated as a high frequency data signal and is coupled by the device 3 to and superimposed on the power conductors of its power cord 3A. The cord 3A carries the high frequency alarm signal to the outlet 7A, thereby making it available to the distribution wiring 8 of the AC electrical service.

A control station 11, also connected to the distribution wiring 8 through another outlet 9 and power cord 10, receives and demodulates the high frequency alarm signal to make it available to the personnel at the control station. In the case shown, the alarm information is displayed on a display unit 12. The personnel at the station 11 are thus alerted to the possible unauthorized removal of the equipment 2 and can take further measures to prevent it. In the event the control station 11 is at a location not directly served by the distribution wiring 8, but by another distribution wiring separated from the wiring 8 by transformers associated with the different wiring, a bridge circuit 8A (shown in dotted line FIG. 1) can be used to couple the signal from one distribution wiring to the other.

Figure 2:
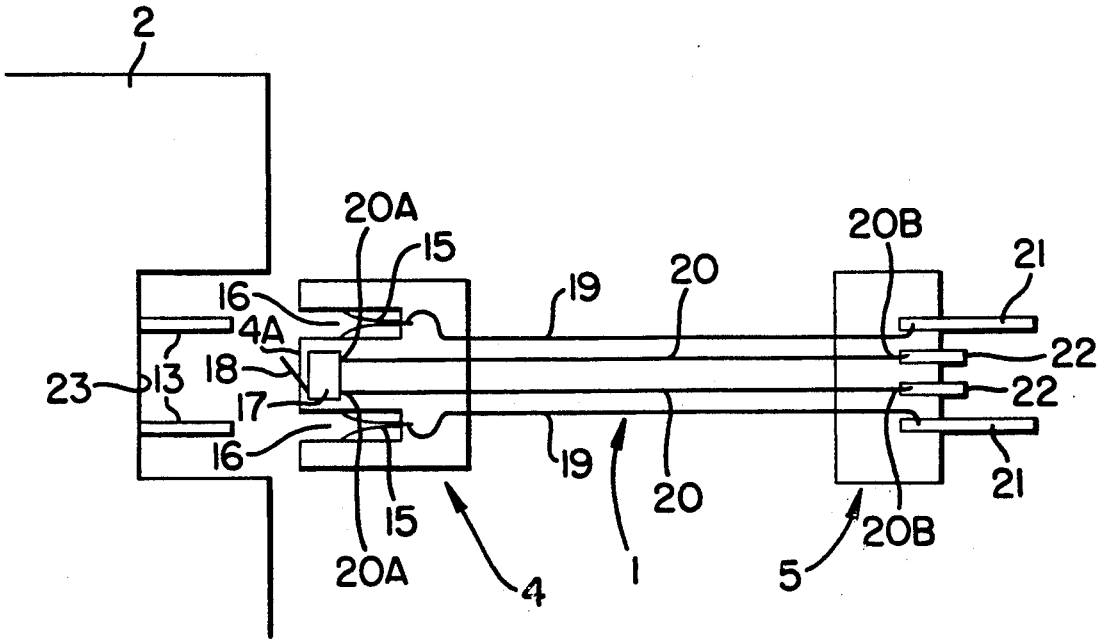
FIG. 2 illustrates the connecting cable of the apparatus of FIG. 1 in greater detail.

FIG. 2 shows the cable 1 in greater detail. As shown, female plug 4 has cavities 16 which accommodate the male plugs 13 of the equipment 2. The male plugs 13 make contact with spring clips 15 supported in the cavities 16 to provide both an electrical and physical connection to the plug 4. Spring clips 15 are, in turn, connected via power conductors 19 to male connectors 21 of the male plug 5.

In accordance with the invention, the cable 1 is further provided with two status conductors 20 and with a micro-switch 17 which together permit the cable to have the above-mentioned first and second states. More particularly, first ends 20A of the status conductors 20 terminate in the plug 4 and there attach to the micro switch 17. The switch 17 is supported in the plug 4 so that its lever arm 18 extends from the wall 4A of the plug which interfaces with the equipment 2. Second ends 20B the status conductors 20 terminate in the plug end 5 of the cable 1 and there connect to further male terminals 22.

As a result of this configuration for the cable 1, when the female plug 4 is attached to the male connectors 13 of the equipment 2, wall section 23 of the equipment pushes the lever arm 18 of switch 17 in a direction away from the equipment, thereby resulting in closure of the the switch and shorting or connecting of the status conductors 20 at the ends 20A. With the cable 1 thus attached to the equipment 1, the status conductors 20 exhibit a first impedance state (corresponding to the first state of the cable 1) in which their resistance as read across terminals 22 is low or near zero. On the other hand, when the female connector 4 is removed or disconnected from the male connectors 13 of the equipment 2, the bias on lever arm 18 moves the arm towards the equipment, thereby disconnecting the ends 20A and opening the circuit between the status conductors 20. With the cable 1 thus disconnected from the equipment 1, a second impedance state (corresponding to the second state of the cable 1) is therefore exhibited by the status conductors 20 in which the resistance as read across the terminals 22 is high approaching infinity.

Figure 3:
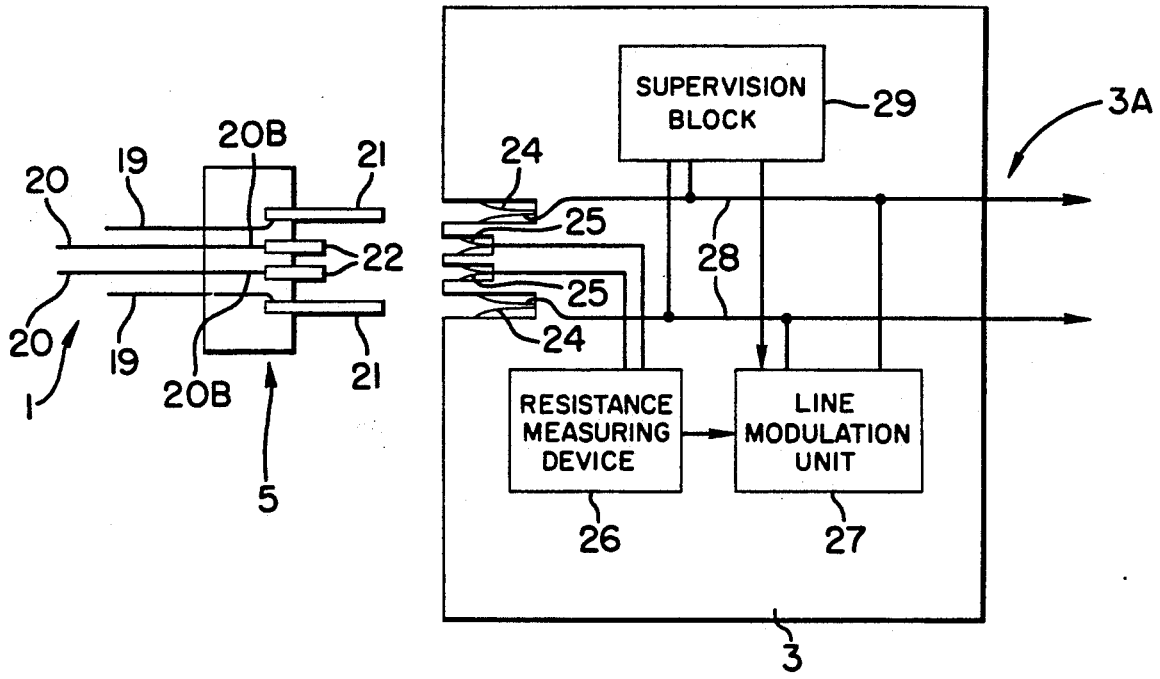
FIG. 3 illustrates the detection and alarm device of the apparatus of FIG. 1 in greater detail.

As above-indicated, the aforesaid first and second states of the cable 1 and, thus, the aforesaid first and second impedance states of the status conductors 20, are detected by the detection and alarm device 3 and an alarm signal is developed when the second state, i.e., second impedance state is detected. FIG. 3 shows one embodiment of the device 3 in greater detail. As illustrated, the male connectors 21 of the plug 5 of cable 1 are received by and mate with a female connector of the device 31 formed by a set of spring clips 24. The spring clips 24, in turn, connect to power conductors 28 of the cable 3A whose female plug end connects to the outlet 7A as above-described. This provides connection of the power conductors 19 of the cable to the outlet.

A further female connector formed by another set of spring clips 25 receives and mates with the male terminals 22 connected to the status conductor ends 20B. These clips also connect to a resistance measuring device 26. The resistance measuring device 26 detects the resistance across spring clips 25 and hence across the status conductors 20 via terminals 22. When the detected resistance becomes high, device 26 outputs a signal to a line modulation unit 27. The unit 27, in response to this signal, then generates a high frequency alarm signal which is superimposed on power conductors 28 for coupling to the outlet 7A.

As can be appreciated, an alarm signal will be generated by the device 26 if the equipment 2 is removed from the cable 1 either by disconnecting or cutting the cable, since this will result in a high resistance across the clips 25. As can also be appreciated, an alarm signal will likewise be generated if the cable 1 is disconnected from the detection and alarm device 3, since in this circumstance a high resistance will also occur across the clips 25.

The remaining case in which an alarm signal is desired is when the detection and alarm device 3 is disconnected from the power source 7A. As shown in FIG. 3, this is accomplished in the the device 3 by including therein a supervision block or circuit SB 29 which results in the desired alarm by failure to respond to a connection verification signal transmitted from the control station 11.

More particularly, high frequency connection verification signals are periodically transmitted to the outlet 7A by the station 11 over the wiring 8. If the alarm and detection device 3 is connected to the outlet 7A, the SB 29 decodes the connection verification signals and outputs a connection present signal to the line modulation unit 27. The unit 27, in turn, initiates a connection acknowledgment signal which is returned over the wiring 8 to the station 11 acknowledging the presence of the device 3 at the outlet 7A. If, on the other hand, the device 3 has been disconnected from the outlet 7A, no acknowledgment signal is generated due to the absence of the SB 29, and the station 11 will recognize this absence of an acknowledge signal as an alarm signal and initiate the appropriate action.

Figure 4:
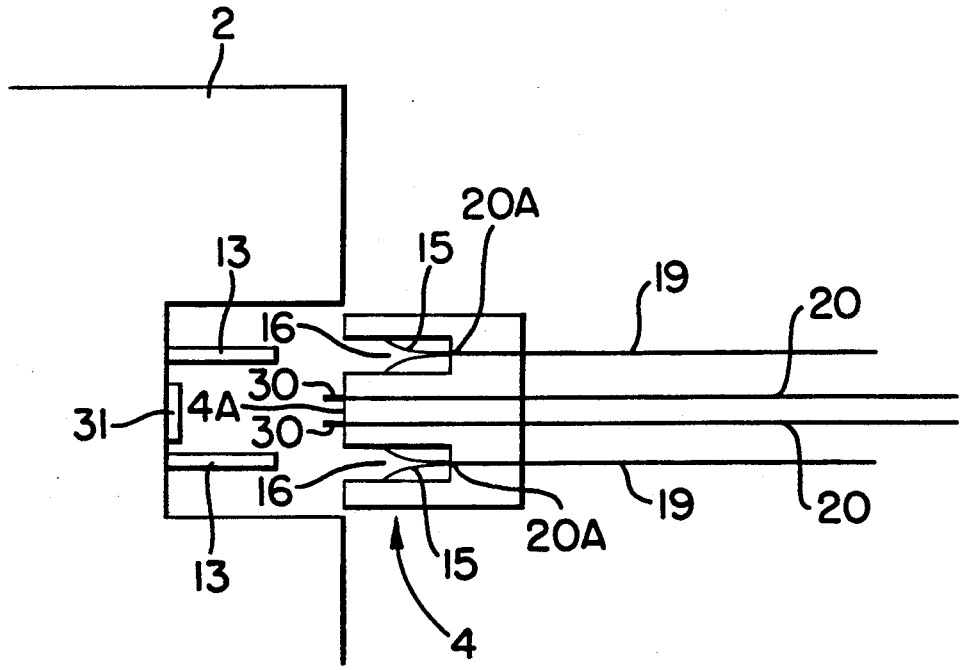
FIGS. 4 and 5 show modifications of the cable of FIG. 2.

FIG. 4. illustrates a modification of the cable 1. In this case, the status conductors 20 pass through the plug 4 and have exposed ends 30 at end wall 4A of the plug. As the plug 4 is connected to the equipment 2, the exposed ends 30 are bridged or shorted by a shorting bar 31 which is mounted on the equipment 2, thereby placing status conductors 20 in their first impedance state. Conversely, when the plug 4 is disconnected from the equipment 2, the exposed ends 30 are brought out of contact with the shorting bar 31, resulting in an open circuit and bringing the status conductors 20 to their second impedance state. Thus, the exposed ends 30 and shorting bar 31 function similarly to the micro switch 17 in the FIG. 2 embodiment.

Figure 5:
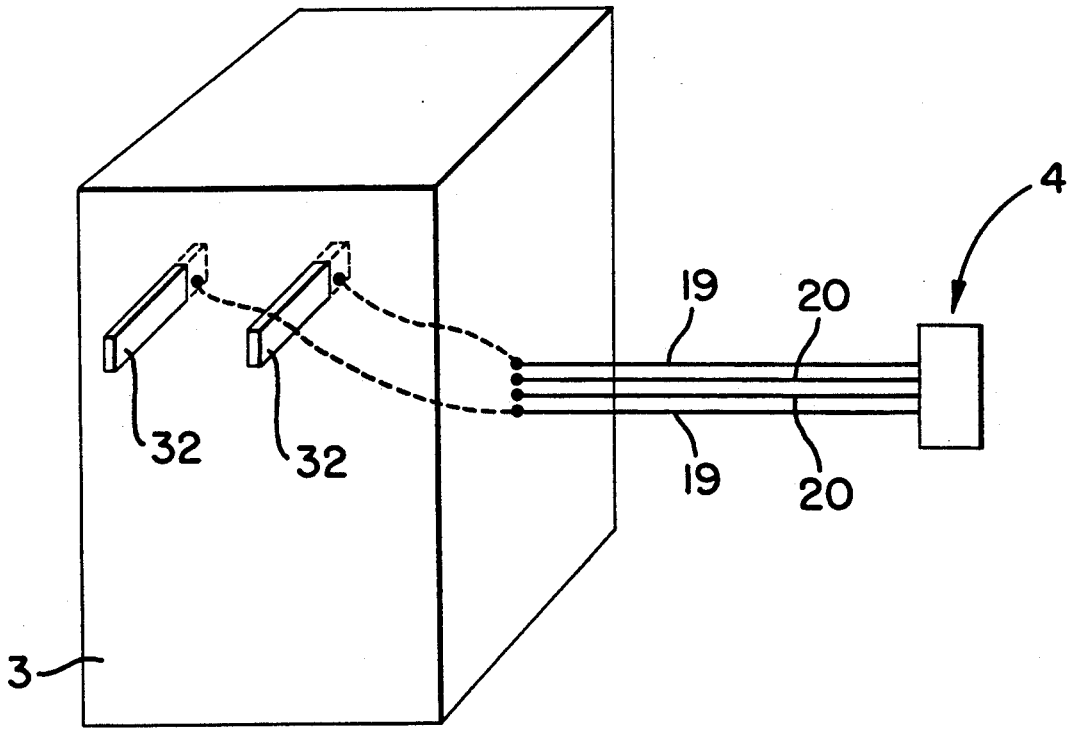

FIG. 5 shows a further modification of the cable 1. In this case, alarm and detection device 3 is itself used to form the male plug end of the cable 1 and the device 3 is permanently and directly attached to the power conductors 19 and the status conductors 20 of the cable. More particularly, the power conductors 19 connect directly through to male connectors 32 provided on an outer wall of the device 3. These connectors are then used to connect the device 3 and cable 1 directly to the outlet 7A. Female connector 4 of the cable 1 in this case is as previously described.

Figure 6:
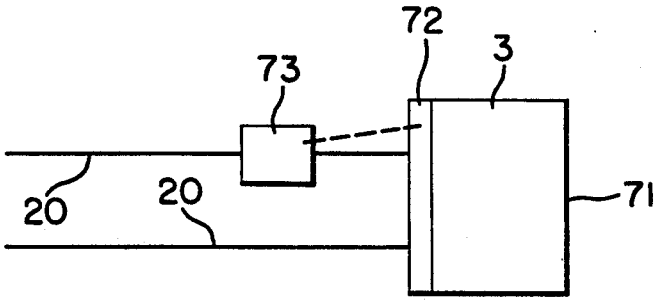
FIG. 6 shows a modification of the detection and alarm device of the apparatus of FIG. 1.

FIG. 6 illustrates schematically a further feature of the invention in which the detection and alarm device 3 is further provided with means to protect it against tampering. In FIG. 6, the device 3 includes an opening 71 at its rear wall for receiving a screw which permits the device to be screwed directly into the wall outlet 7A. The device 3 also includes a removable front cover 72 which allows connecting the device 3 to the outlet 7A via the opening 71 and which additionally cooperates with a microswitch 73 which is in series with one of the status conductors 20.

The microswitch 73 is closed when the cover 72 is fully on the device 3 and open when the cover is partially or totally removed from the device. As a result, opening or removing the cover, causes an open circuit condition between the conductors 20. As above-indicated, such a condition causes the device 3 to generate an alarm signal so that when any attempt is made to partially or totally remove the cover 72, this fact is made known to the control station 11.

In all cases it is understood that the above-described arrangements are merely illustrative of the many possible specific embodiments which represent applications of the present invention. Numerous and varied other arrangements can be readily devised in accordance with the principles of the present invention without departing from the spirit and scope of the invention. Thus, for example, in FIG. 2, one of the status conductors 20 can also serve as a ground conductor for the cable 1. Also, the micro-switch 17 might be replaced by a reed relay with its corresponding magnet on the equipment side or the cable side. Furthermore, instead of the control station 11 periodically transmitting connection verification signals to the detection and alarm device 3, the latter device can itself periodically transmit connection acknowledgement signals to be monitored by the station 11.

I claim:

1. Apparatus for use with electrical equipment, the equipment being adapted to be supplied power from a power source, the apparatus comprising:

a connecting cable for use in connecting the electrical equipment to the power source, the connecting cable being adapted to be in a first state when connected to the electrical equipment and in a second state when disconnected from the electrical equipment, said cable including: first and second status conductors adapted to exhibit a first impedance value between the individual status conductors corresponding to said first state when the cable is connected to the electrical equipment and a second impedance value between the individual status conductors corresponding to said second state when the cable is disconnected from the electrical equipment; said status conductors being formed from conductors which are other than ungrounded power conductors for carrying power from said power source to said equipment.

2. Apparatus in accordance with claim 1 further comprising:

means for detecting when said cable is in said second state for generating an alarm signal.

3. Apparatus in accordance with claim 2 further comprising:

a control station for receiving said alarm signal and for transmitting a connection verification signal to said detecting means to verify the presence of said detecting means.

4. Apparatus in accordance with claim 3 wherein:

said detecting means includes means for generating an acknowledgement signal for acknowledging to said control station receipt of said connection verification signal.

5. Apparatus in accordance with claim 1 wherein:

said first and second states are detectable electrical states.

6. Apparatus in accordance with claim 1 wherein:

said second impedance value is greater than said first impedance value.

7. Apparatus in accordance with claim 1 wherein:

said status conductors are adapted to exhibit said first and second impedance values by electrical connection and disconnection of said status connectors.

8. Apparatus in accordance with claim 7 wherein:

said cable further comprises: a switch connected between the status conductors and adapted to be in a closed and opened state, respectively, when said cable is connected and disconnected from the equipment.

9. Apparatus in accordance with claim 8 wherein:

said switch is located at a first end of said cable and is adapted to be closed and opened by being brought into and out of contact with the equipment.

10. Apparatus in accordance with claim 9 wherein:

said switch is a micro-switch having a movable contact for opening and closing said switch, said contact being adapted to close said switch when said cable is connected to the equipment.

11. Apparatus in accordance with claim 9 wherein: said cable further comprises:
first and second power conductors;
and first and second connectors situated at the first end and a second end of the cable and connected to the first and second power conductors.

12. Apparatus in accordance with claim 11 wherein: said switch is housed within said first connector;
and said status conductors have terminals located at said second end of said cable and accessible through said second connector.

13. Apparatus in accordance with claim 12 wherein: said first and second connectors are female and male connectors, respectively.

14. Apparatus in accordance with claim 7 wherein: said status conductors have: first ends accessible from a first end of said cable and adapted to be electrically connected and disconnected when said cable is connected to and from said equipment.

15. Apparatus in accordance with claim 7 wherein: said status conductors are adapted to exhibit said first and second impedance values by electrically connecting and disconnecting first ends of said status conductors located at a first end of said cable.

16. Apparatus in accordance with claim 15 further comprising:
means located at a second end of said cable for detecting the impedance across said status conductors and generating an alarm signal.

17. Apparatus in accordance with claim 16 wherein: said cable further comprises: first and second power conductors; first and second connectors connected to the second end of said cable, said first connector being connected to first ends of said power conductors and said second connector being connected to second ends of said status conductors;
and said detecting means further includes: third and fourth connectors adapted to mate with said first and second connectors; and a fifth connector adapted to be electrically connected to said third connector.

18. Apparatus in accordance with claim 17 wherein: said first, second and fifth connectors are male connectors and said third and fourth connectors are female connectors.

19. Apparatus in accordance with claim 17 wherein: said detecting means couples said alarm signal across said fifth connector.

20. Apparatus in accordance with claim 19 wherein: said detecting means converts said alarm signal to a high frequency signal prior to coupling said alarm signal to said fifth connector.

21. Apparatus in accordance with claim 20 wherein: said detecting means includes means for providing an acknowledgement signal to said fifth connector.

22. Apparatus in accordance with claim 16 wherein: said cable further comprises first and second power conductors and a first connector at said first end of said cable connected to first ends of said power conductors;
second ends of said status conductors terminate in said detecting means;
second ends of said power conductors terminate in said detecting means;
and said detecting means includes a second connector accessible from outside said detecting means and connected to said second ends of said power conductors.

23. Apparatus in accordance with claim 22 wherein: said detecting means couples said alarm signal to said second connector.

24. Apparatus in accordance with claim 23 wherein; said detecting means converts said alarm signal to a high frequency signal prior to coupling said alarm signal to said second connector.

25. Apparatus in accordance with claim 22 wherein: said first connector is a female connector; and said second connector is a male connector.

26. Apparatus in accordance with claim 16 wherein; said detecting means includes means for permitting connection of said detecting means to an AC outlet.

27. Apparatus in accordance with claim 16 wherein: said detecting means further includes: a removable cover; and switch means for causing said status conductors to exhibit said second impedance when said cover is partially or fully removed from said detecting means.

28. A method for use with electrical equipment to be supplied power from a power source comprising:
providing a cable for use in connecting the equipment to the power source, the cable having a first state when the cable is connected to the equipment and a second state when the cable is disconnected from the equipment and including: first and second status conductors adapted to have a first impedance level corresponding to said first state when said cable is connected to said equipment and a second impedance level corresponding to said second state when said cable is disconnected from said cable; said first and second status conductors being formed from conductors which are other than ungrounded power conductors for carrying power from said power source to said equipment;
and detecting the state of the cable by determining the impedance across the first and second status conductors in said cable and generating an alarm signal when the cable is in the second state.

29. A method in accordance with claim 28 wherein: said second impedance level is higher than said first impedance level.

* * * * *

UNITED STATES PATENT AND TRADEMARK OFFICE

CERTIFICATE OF CORRECTION

PATENT NO. : 5,034,723

DATED : July 23, 1991

INVENTOR(S) : Maman

It is certified that error appears in the above-identified patent and that said Letters Patent is hereby corrected as shown below:

Title Page:

Item [57], line 8. Change "repair" to -- regular --

Col. 2, line 61. Change "snows" to -- shows --

Col. 3, line 68. After "20B" insert -- and --

Col. 4, line 62. Delete "the" second occurrence.

Signed and Sealed this

Fifth Day of January, 1993

*Attest:*

*Attesting Officer*

DOUGLAS B. COMER

*Acting Commissioner of Patents and Trademarks*